United States Patent [19]

Sinkhorn

[11] 4,178,026

[45] Dec. 11, 1979

[54] SECURITY DOOR LOCK

[76] Inventor: William A. Sinkhorn, 2249 N. Medina Line Rd., Akron, Ohio 44313

[21] Appl. No.: 882,451

[22] Filed: Mar. 1, 1978

[51] Int. Cl.[2] ..... E05C 1/04

[52] U.S. Cl. ..... 292/295; 292/288; 292/DIG. 15

[58] Field of Search ..... 292/DIG. 15, 288, 294, 292/295, 292, 293, 296, 343

[56] References Cited

U.S. PATENT DOCUMENTS

| | | | |
|---|---|---|---|
| 614,052 | 11/1898 | Jackson | 292/295 |
| 928,820 | 7/1909 | Tabor | 292/296 X |
| 1,308,473 | 7/1919 | Boehringer et al. | 292/295 |
| 1,469,800 | 10/1923 | McCleeary | 292/216 |
| 3,834,746 | 9/1974 | Hinden | 292/295 |
| 3,844,598 | 10/1974 | Clabough | 292/295 |

*Primary Examiner*—Richard E. Moore

[57] ABSTRACT

This door lock provides for locking a door securely from the inside, and it consists primarily of a lock housing, which is slidable on a lock plate. The lock plate includes an integral pin, which is placed in an anchor plate that is fastened secure, to the threshold of the door. The device includes, on its interior, a spring-loaded push-bar and a locking pin, for rendering the lock housing secure to the door and lock plate, and it further includes a recessed set screw to hold the locking pin secure, in the event a would be intruder breaks a glass in a door provided with such, in order to push the push-bar for releasing the lock.

9 Claims, 5 Drawing Figures

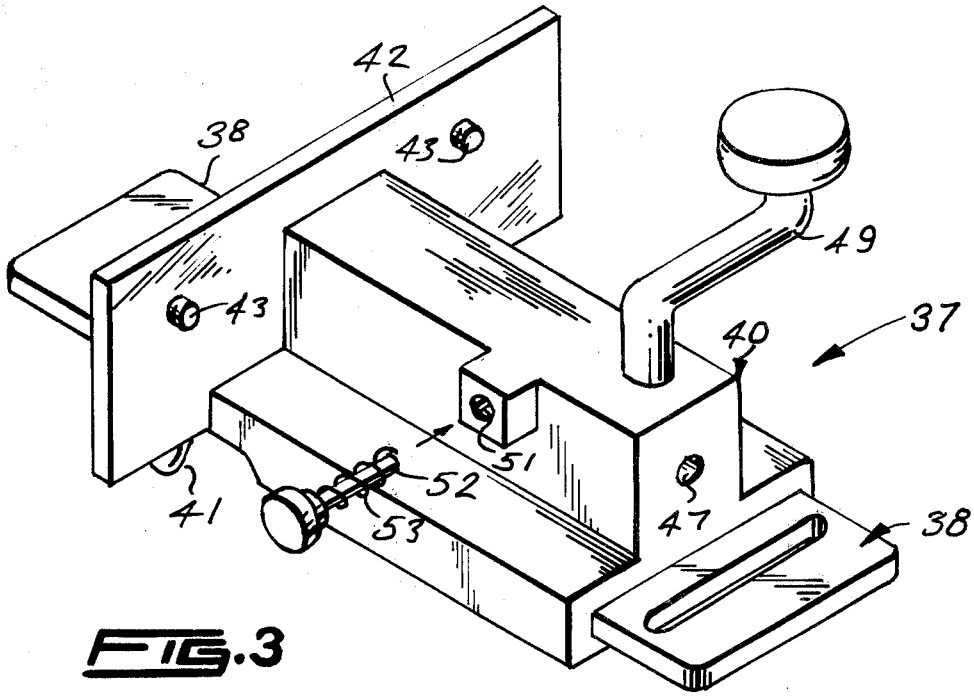
FIG. 3
FIG. 4
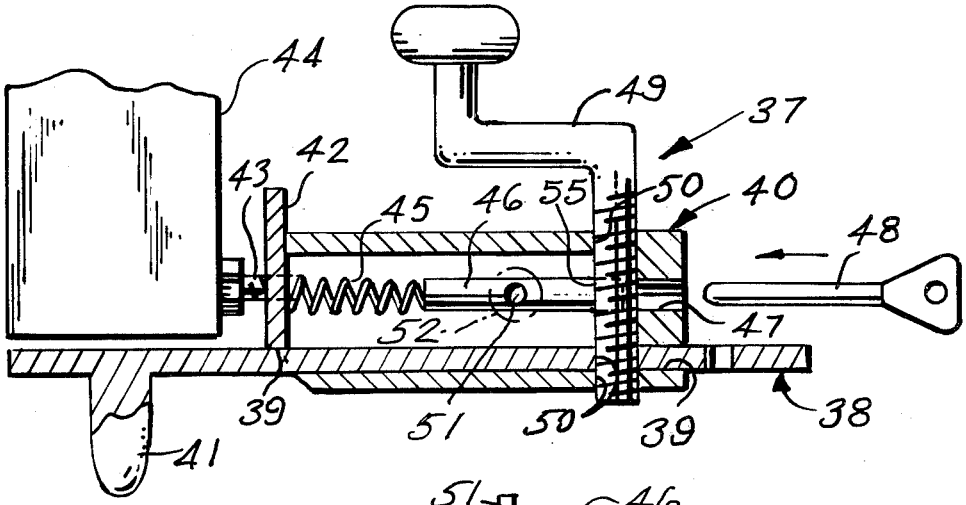
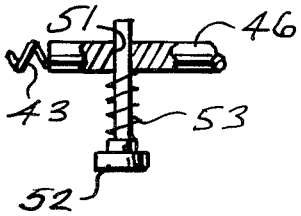
FIG. 5

SECURITY DOOR LOCK

This invention relates to locks, and more particularly to a security door lock.

It is, therefore, the principal object of this invention to provide a security door lock, which will effectively secure a door, to prevent it from being opened by an intruder.

Another object of this invention is to provide a security door lock, which cannot be picked, nor can it be pried open, without the intruder breaking the door down, and the lock is easily installed and is removable easily, when desired.

Another object of this invention is to provide a security door lock, which may be installed at the door threshold, or anywhere around the perimeter of the door, but not to the door itself, and it may be installed on any type of swing door, and it is adaptable for use on doors and thresholds made of wood or metal.

A further object of this invention is to provide a security door lock, of the character described, which will eliminate the prior art use of additional locks, such as the chain type, and other security mechanisms.

Other objects of the invention are to provide a security lock, which is simple in design, inexpensive to manufacture, rugged in construction, easy to use and efficient in operation.

These, and other objects, will be readily evident, upon a study of the following specification, and the accompanying drawings, wherein:

FIG. 3 is a partially exploded perspective view, showing a modified form of the invention;

FIG. 4 is a longitudinal cross-sectional view of FIG. 3, shown in use, and it illustrates the spring-loaded pin in phantom, and FIG. 5 is a fragmentary top plan view of the bolt and removable spring-loaded pin, shown removed from FIGS. 3 and 4.

Figure 1:
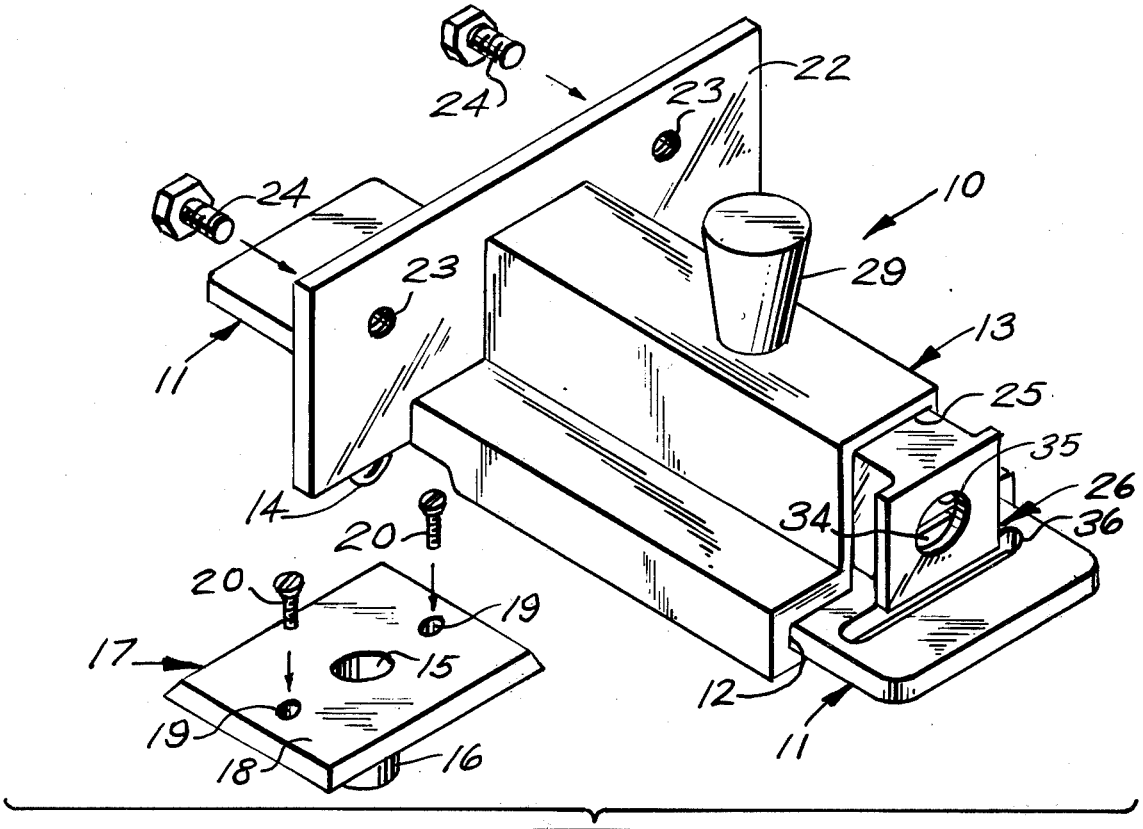
FIG. 1 is a partially exploded perspective view of the preferred embodiment of the present invention.

According to this invention, a lock 10 is shown to include a horizontal and elongated lock plate 11, which is received slidably within opening 12 of lock housing 13. A pin 14, integral of lock plate 11, on the underside 11*a* thereof, is removably received within opening 15 of the sleeve 16 of anchor plate 17. The flange 18, of anchor plate 17, is provided with a pair of spaced-apart openings 19, for receiving suitable fasteners 20, which secure anchor plate 17 to the threshold 21. An opening 21*a* is drilled in the threshold 21, so as to install anchor plate 17. A rectangular front plate 22 is fixedly secured to one end of lock housing 13, in a suitable manner, and front plate 22 is provided with a pair of threaded openings 23, which receive threaded bolt fasteners 24.

It shall be noted, that the front surface of front plate 22 is provided with a felt pad, so as to prevent marring the finish of the door 24*a*. The bolt fasteners 24 are also rubber tipped, for the same purpose, and they are adjustable, so as to abut against door 24*a*, when lock 10 is in use.

The upper portion 25 of the opening 12, of lock housing 13, slidably receives flange ended push-bar 26. A coil spring 27, in lock housing 13, urges against the end 28 of push-bar 26, and urges against front plate 22 at its opposite end for a purpose, which hereinafter will be described. A knob 29 is freely received in opening 30, of lock housing 13. Fixedly secured to knob 29, is a locking pin 31, which is freely received in opening 32 of push-bar 26, and the large lower end or head 31*a* is freely received in openings or apertures 33 of locking plate 11, and lock housing 13. A set screw 34 is threadingly received in opening 35 of push-bar 26, so as to prevent an intruder from breaking any glass, if any, in the door 24*a*, and reaching in to push the push-bar 26, so as to release the locking pin 31 from the opening 33. An opening or slot 36, in lock plate 11, provides further means of securing lock 10, by receiving a padlock or the like, therein, which prevents the housing 13 from being removed from the locking plate 11. The above mentioned is optional.

It shall also be noted, that the anchor plate 17 is not necessary, when lock 10 is installed on a door having a metal threshold. An opening need only be drilled in a metal threshold, for receiving the pin 14 of locking plate 11.

In use, after drilling the opening 21*a*, the anchor plate 17 is secured to the threshold 21, and the locking plate 11 is put in place, so that the pin 14 thereof is entered into the opening 15. The lock housing 13 is then slid into place on the locking plate 11, until the lower end 31*a* of locking pin 31 is received in the opening 33 of lock housing 13 and the lock plate 11. When this is done, the bolt fasteners 24 are in abutment with the door 24*a*, as shown in FIG. 1 of the drawings. The set screw 34 is then advanced against pin 31, as shown only when lock 10 is used with doors having glass therein, which may be broken by the intruder, as was heretofore described. When it is desired to release lock 10, the user releases the set screw 34, if used, and then lifts knob 29, after pushing push-bar 26 inwards, which will lift the lower end 31*a* of pin 31, out of the opening 33. The housing 13 may then be slid away from the lock plate 11, after which, the lock plate and its pin 14 are removed from the anchor plate 17, which will enable the door 24*a* to be opened.

Figure 2:
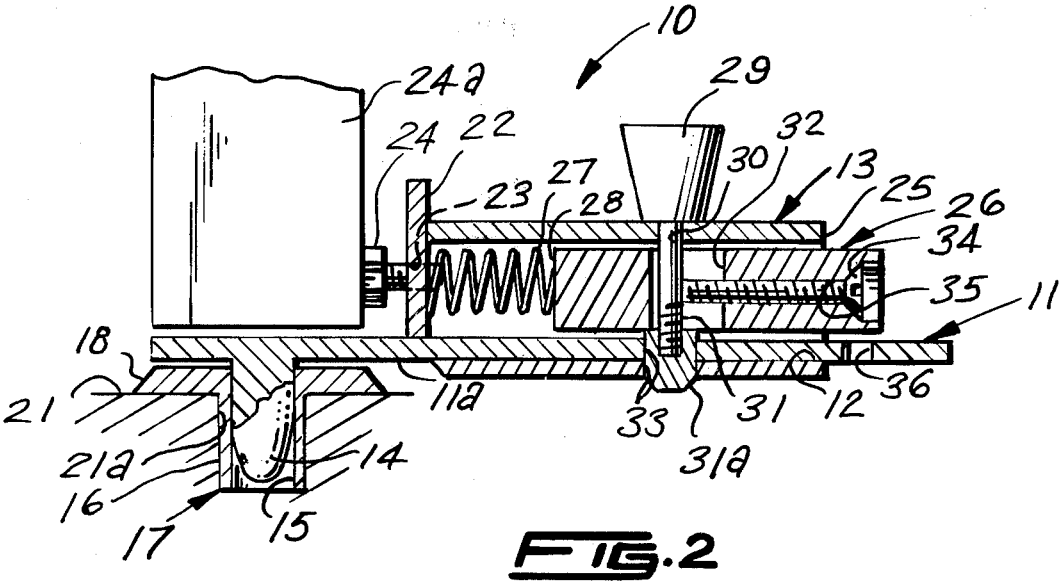
FIG. 2 is a longitudinal cross-sectional view of FIG. 1, shown in use.

It shall further be recognized, that the bottom of the opening 32, of push-bar 26, serves as stop means against the top of the enlarged end 31*a* of pin 31, as shown in FIG. 2 of the drawing.

Referring now to FIGS. 3, 4, and 5 of the drawings, a modified form of the invention is shown to include a lock 37, having a locking plate 38, similar to that of the preferred embodiment 10. Locking plate 38 is slidable in opening 39 of lock housing 40, and it includes an integral pin 41, for being received in an anchor plate. A front plate 42 is provided with bolt fasteners 43, which abut with door 44. A coil spring abuts with plate 42 at one end and is secured fixedly at its other end, to an end of inter-locking pin 46. Pin 46 aligns with openings 47, in which a push-in locking key 48 is received. The locking crank bolt 49 is threaded into the opening 50 of housing 40, and the locking plate 38, so as to render door 44 secure against entry. An opening 51, transversely through interlocking pin 46, removably receives pin 52 having spring 53.

The lock 37 functions in a similar manner as does the aforementioned lock 10, with the exception of having a threaded locking crank bolt 49, and an inter-locking pin 46, which enters the opening 55 of crank bolt 49. The push-in locking key 48, of lock 37, is the means of unlocking lock 37, and the pin 52 serves as a secondary locking means for the interlocking pin 46.

While various changes may be made in the detail construction, it is understood that such changes will be within the spirit and scope of the present invention, as is defined by the appended claims.

What I now claim is:

1. In combination with a door frame, a door mounted on said door frame and movable between an open and a closed position, a security door lock, said security door lock comprising: a lock housing, a slidable lock plate received in said lock housing, a pin presented from said lock plate, means in said door frame to receive said pin against lateral movement, said pin being insertable in said means only when the door is in the open position, a locking pin received in said lock housing and selectively engaging said lock plate for rendering said lock plate secure to said lock housing and thereby securing the door in its closed position against an intruder, a push-bar slidably received in said lock housing and manually movable between at least a first and a second position, said push bar engaging said locking pin and maintaining it in engagement with said lock plate when said push bar is disposed in said first position, said push bar disengaging from said locking pin to permit withdrawal of said locking pin from said lock plate when said push bar is disposed in said second position, spring means biasing said push bar toward said first position, and a knob external of said lock housing for lifting and lowering said locking pin.

2. The combination, as set forth in claim 1, in which the door frame includes a threshold, an anchor plate secured to said threshold, a sleeve secured to said anchor plate and extending into said threshold, a longitudinal opening being provided through said lock housing, said lock plate being elongated in configuration with opposed ends and being received in the lower portion of said longitudinal opening through said lock housing, said pin being presented in proximity to one end of said lock plate and being insertably received in the sleeve of said anchor plate.

3. The combination, as set forth in claim 9, in which a front plate is fixedly secured to said lock housing, a pair of bolt fasteners being mounted on said front plate, each said bolt fastener provided with a tip portion to engage the door, means to adjust the axial disposition of said tip portions relative to the door.

4. The combination, as set forth in claim 10, in which said push bar is slidably received in the longitudinal opening through said lock housing and is disposed upwardly with respect to said lock plate, said spring means being disposed between said push bar and said front plate, and an opening extending transversely through said push bar, said locking pin extending through said transverse opening.

5. The combination, as set forth in claim 4, in which said locking pin has a shank portion and a lower head portion, the transverse dimension of said head portion being larger than the transverse dimension of said shank portion, an aperture in said lock plate, said head portion being selectively received within the aperture in said lock plate to secure the lock housing and lock plate against relative movement, said shank portion being freely receivable within the transverse opening in said push bar, said head portion being retractible from the aperture in said lock plate to be received within said transverse opening in said push bar when said push bar is in its said second position, said push bar engaging the head portion on said locking pin as a stop to block retraction of said head portion from said lock plate and into the transverse opening in said push bar when the push bar is in said first position.

6. The combination, as set forth in claim 5, in which an aperture is provided in said lock housing to register with the aperture in said lock plate, the head portion of said lock pin simultaneously engaging both said registered apertures selectively to preclude relative movement of said lock plate with respect to said lock housing.

7. The combination, as set forth in claim 1, in which means are provided selectively to prevent movement of said push bar from said first to said second position.

8. The combination, as set forth in claim 7, in which said means selectively to prevent movement of said push bar comprises a set screw threadably received within said push bar selectively to engage said lock pin when it is desired to obviate movement of said push bar from its said first position.

9. The combination, as set forth in claim 1, in which said lock plate is of elongate configuration with opposed ends, said pin being presented in proximity to one said end and a slot being provided in proximity to the opposite said end, said slot adapted to receive a padlock and thereby preclude removal of said lock housing from said lock plate.

* * * * *